US008683927B2

(12) United States Patent
Sun et al.

(10) Patent No.: US 8,683,927 B2
(45) Date of Patent: Apr. 1, 2014

(54) RAILROAD CAR WHEEL TRUCK

(71) Applicant: CSR Yangtze Co., LTD., Wuhan (CN)

(72) Inventors: Mingdao Sun, Wuhan (CN); Yong Xu, Wuhan (CN); Baolei Wang, Wuhan (CN); Yongjiang Li, Wuhan (CN); Hui Luo, Wuhan (CN); Wanlu Gong, Wuhan (CN); Guangyi Xiao, Wuhan (CN)

(73) Assignee: CSR Yangtze Co., Ltd., Wuhan (CN)

( * ) Notice: Subject to any disclaimer, the term of this patent is extended or adjusted under 35 U.S.C. 154(b) by 0 days.

(21) Appl. No.: 13/664,405

(22) Filed: Oct. 30, 2012

(65) Prior Publication Data

US 2013/0055922 A1 Mar. 7, 2013

Related U.S. Application Data

(63) Continuation-in-part of application No. PCT/CN2010/079599, filed on Dec. 9, 2010.

(30) Foreign Application Priority Data

May 14, 2010 (CN) ..... 2010 1 0176894

(51) Int. Cl.
*B61F 3/00* (2006.01)

(52) U.S. Cl.
USPC ..... 105/197.05; 105/198.2

(58) Field of Classification Search
USPC ..... 105/196, 197.05, 197.1, 197.2, 198, 105/198.1, 198.2, 198.3, 198.4, 198.5, 105/199.3, 199.4
See application file for complete search history.

(56) References Cited

U.S. PATENT DOCUMENTS

| | | | | |
|---|---|---|---|---|
| 5,138,954 | A * | 8/1992 | Mulcahy | 105/199.3 |
| 5,752,564 | A * | 5/1998 | Callahan et al. | 164/137 |
| 5,806,435 | A * | 9/1998 | Pitchford | 105/199.3 |
| 5,954,114 | A * | 9/1999 | Bauer et al. | 164/137 |
| 6,196,134 | B1 * | 3/2001 | Stecker | 105/226 |
| 6,354,226 | B2 * | 3/2002 | Stecker | 105/226 |
| 6,622,776 | B2 * | 9/2003 | Bauer et al. | 164/137 |
| 6,659,016 | B2 * | 12/2003 | Forbes | 105/355 |
| 6,672,224 | B2 * | 1/2004 | Weber et al. | 105/187 |
| 7,681,506 | B2 * | 3/2010 | Forbes et al. | 105/226 |
| 7,823,513 | B2 * | 11/2010 | Forbes et al. | 105/193 |
| 8,413,592 | B2 * | 4/2013 | Forbes et al. | 105/453 |
| 2004/0129168 | A1 * | 7/2004 | Forbes | 105/197.05 |

(Continued)

FOREIGN PATENT DOCUMENTS

WO WO 2008070953 A1 * 6/2008 ..... B61F 5/52

*Primary Examiner* — Jason C Smith
(74) *Attorney, Agent, or Firm* — Matthias Scholl P.C.; Matthias Scholl

(57) ABSTRACT

A wheel truck for a railroad car, including: a front wheel pair assembly and a rear wheel pair assembly; two side frame assemblies, each side frame assembly including a square box and journal-box guides; two spring suspension devices; and a bolster assembly including two ends disposed on the two spring suspension devices, respectively. The bolster assembly includes a pilot hole in the center and two mounting holes on the two ends, the pilot hole is rotationally matched with a cylindrical upper center plate of a car body for transmitting vertical and horizontal forces from the car body, and the two mounting holes are disposed above the two spring suspension devices, respectively. Each mounting hole receives a lower side bearing, and the lower side bearing is matched with a corresponding upper side bearing disposed on each side of the car body for transmitting the vertical load from the car body.

6 Claims, 5 Drawing Sheets

(56) References Cited

U.S. PATENT DOCUMENTS

| | | | | |
|---|---|---|---|---|
| 2008/0229968 | A1* | 9/2008 | Gedenk et al. | 105/198.7 |
| 2009/0242335 | A1* | 10/2009 | Taylor | 188/47 |
| 2010/0107923 | A1* | 5/2010 | Rodet et al. | 105/197.05 |
| 2010/0162919 | A1* | 7/2010 | Aitken et al. | 105/198.2 |
| 2011/0036264 | A1* | 2/2011 | Sammartino | 105/198.2 |
| 2011/0185939 | A1* | 8/2011 | Forbes et al. | 105/168 |
| 2012/0318165 | A1* | 12/2012 | Xu et al. | 105/197.05 |
| 2012/0318166 | A1* | 12/2012 | Wike | 105/198.2 |
| 2013/0008337 | A1* | 1/2013 | Liu et al. | 105/198.2 |
| 2013/0047882 | A1* | 2/2013 | Sun et al. | 105/198.2 |
| 2013/0055922 | A1* | 3/2013 | Sun et al. | 105/197.05 |

* cited by examiner

RAILROAD CAR WHEEL TRUCK

CROSS-REFERENCE TO RELATED APPLICATIONS

This application is a continuation-in-part of International Patent Application No. PCT/CN2010/079599 with an international filing date of Dec. 9, 2010, designating the United States, now pending, and further claims priority benefits to Chinese Patent Application No. 201010176894.1 filed May 14, 2010. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a wheel truck of a railroad freight car.

2. Description of the Related Art

As a critical part of a railroad freight car, a typical wheel truck includes two side frame assemblies and a bolster assembly. Journal-box guides disposed on two ends of the frame assembly are fixed on a front wheel pair and a rear wheel pair via roller bearing adapters, respectively. The bolster assembly has two ends, each of which is mounted in a central square box of the side frame assembly via a spring suspension device for supporting the load from the bolster assembly. The bolster assembly includes a lower center plate in the center and two lower side bearings on two ends. The lower center plate and the lower side bearings are matched with an upper center plate and two upper side bearings on the lower base of the freight car for supporting the weight of the freight car.

In early supporting structure of the freight car, the lower center plate of the bolster assembly supported all loads of the car body, whereas the lower side bearings assisted for positioning. Thereafter, in order to improve the critical speed of an empty freight car, the lower center plate was improved as a primary bearing structure, and the lower side bearing was improved to assist for supporting. The friction between the upper and lower side bearings can act as a resistance during the turnaround of the wheel truck to meet the requirement of speed-raising.

In above descriptions, the supporting achieved totally by the lower center plate and the supporting achieved by the combination of the lower center plate and the lower side bearings are commonly called center plate-type supporting. The wheel truck having the center plate-type supporting is advantageous in that when crossing curved tracks, the wheel truck is flexible in turning around, and the load is uniformly distributed on the wheels. However, it has defects that the vertical load of the body is directly applied on the center of the bolster assembly, and transmitted to the square boxes via the bolster assembly, which results in a large bending moment and sectional area of the bolster assembly. Correspondingly, the weight and the production cost of the assembly are increased, and the center plate has a low stability in rolling. Thus, it is very significant to eliminate the large bending moment produced by the bolster assembly and improve the performance and the running stability of the freight car when crossing curved tracks.

SUMMARY OF THE INVENTION

In view of the above-described problems, it is one objective of the invention to provide a wheel truck that has a light weight, reasonable stress state, good performance in crossing curved tracks, stable running, and meets the requirement of the speed-raising.

To achieve the above objective, in accordance with one embodiment of the invention, there is provided a wheel truck, comprising: a front wheel pair assembly and a rear wheel pair assembly; two side frame assemblies, each side frame assembly comprising a square box in a center and journal-box guides on two ends, and the journal-box guides being disposed on roller bearing adapters; two spring suspension devices, the two spring suspension devices being disposed in the square boxes of the two side frame assemblies, respectively; and a bolster assembly comprising two ends which are disposed on the two spring suspension devices, respectively. The bolster assembly comprises a pilot hole in a center and two mounting holes on the two ends, the pilot hole is rotationally matched with a cylindrical upper center plate of a car body for transmitting vertical and horizontal forces from the car body, and the two mounting holes are disposed above the two spring suspension devices, respectively. Each mounting hole receives a lower side bearing, and the lower side bearing is matched with a corresponding upper side bearing disposed on each side of the car body for transmitting the vertical load from the car body.

The vertical load of the car body is directly transmitted to the lower side bearings via the upper side bearings, then to the bolster assembly, and finally to the spring suspension device of the side frame assembly. The bolster assembly just bears pressures from the lower side bearings and the spring suspension device, and in the meanwhile, bending moment cannot be produced due to the vertical load of the car body. Thus, the weight of the bolster assembly can be largely decreased, and the stability of the bolster assembly can be greatly improved.

In a class of this embodiment, the lower side bearing comprises a first friction board, a second friction board, an inner pedestal, a bearing sleeve sleeving the inner pedestal, a pressure block, and an elastic component. The pressure block is disposed on an upper part of the inner pedestal, and the second friction board is disposed on a top of the pressure block. The first friction board is disposed on a top of the bearing sleeve. A friction coefficient of the first friction board $\mu_k$ and a friction coefficient of the second friction board $\mu_z$ meet the relation: $\mu_k > \mu_z$. The elastic component is disposed between the inner pedestal and the bearing sleeve for controlling a relative position of the inner pedestal and the bearing sleeve. A mechanical property of the elastic component meets following requirements: a) in an empty loaded state, a level position of the first friction board is higher than that of the second friction board so that the first friction board bears the load of the car body; and b) in a heavy loaded state, the level position of the first friction board is equal to that of the second friction board so that the first friction board and the second friction board bear the load of the car body.

The lower side bearing comprises the first friction board and the second friction board for supporting load in empty and heavy states; and the relative position of such friction boards are limited by the elastic component. When the car body is in the empty state, the weight of the car body is supported only by the first friction board, at this moment, the lower side bearing is in an elastic state, acting as a third elastic suspension system. Because the first friction board has a larger friction coefficient and a large static deflection, the critical speed and the safety in wheel load reduction can be improved during the empty state. When the car body is in the heavy loaded state, the first friction board is pressed down to the same level position as the second friction board. In such a state, both the first friction board and the second friction board support the load of the car body, the lower side bearing is in a rigid supporting state, and the stability of the freight car during the rolling of the wheel is improved. Because the second friction board has a smaller friction coefficient, the wheel truck has a good performance in crossing the curved racks in the heavy loaded state.

Advantages of the invention are summarized as follows:

1. Because the pilot hole of the bolster assembly only bears the vertical and horizontal forces from the car body, the bending moment produced on the bolster assembly is almost equal to zero. Thus, the weight of the bolster assembly, the weight of the wheel truck can be largely reduced, and in turn the cost of production and maintenance can be reduced. At the same time, the stability of the freight car during the rolling of the wheel is improved.
2. The lower side bearing comprises two friction boards for supporting load in both empty and heavy states. In the empty state, the first friction board having a larger friction coefficient can produce a large friction torque to improve the critical speed; whereas in the heavy state, the second friction board having a smaller friction coefficient can prevent the friction torque of the side bearing from being too large, and further reduce the horizontal force on the wheel track exerted by the car body when crossing curved tracks. Thus, the heavy loaded wheel truck has a superb dynamic performance for crossing curved tracks, and meets high requirements for designing speed-raising trains of 120 km/h.

BRIEF DESCRIPTION OF THE DRAWINGS

The invention is described hereinbelow with reference to the accompanying drawings, in which.

DETAILED DESCRIPTION OF THE EMBODIMENTS

To further illustrate the invention, experiments detailing a wheel truck are described. It should be noted that the following examples are intended to describe and not limited to the invention.

Figure 1:
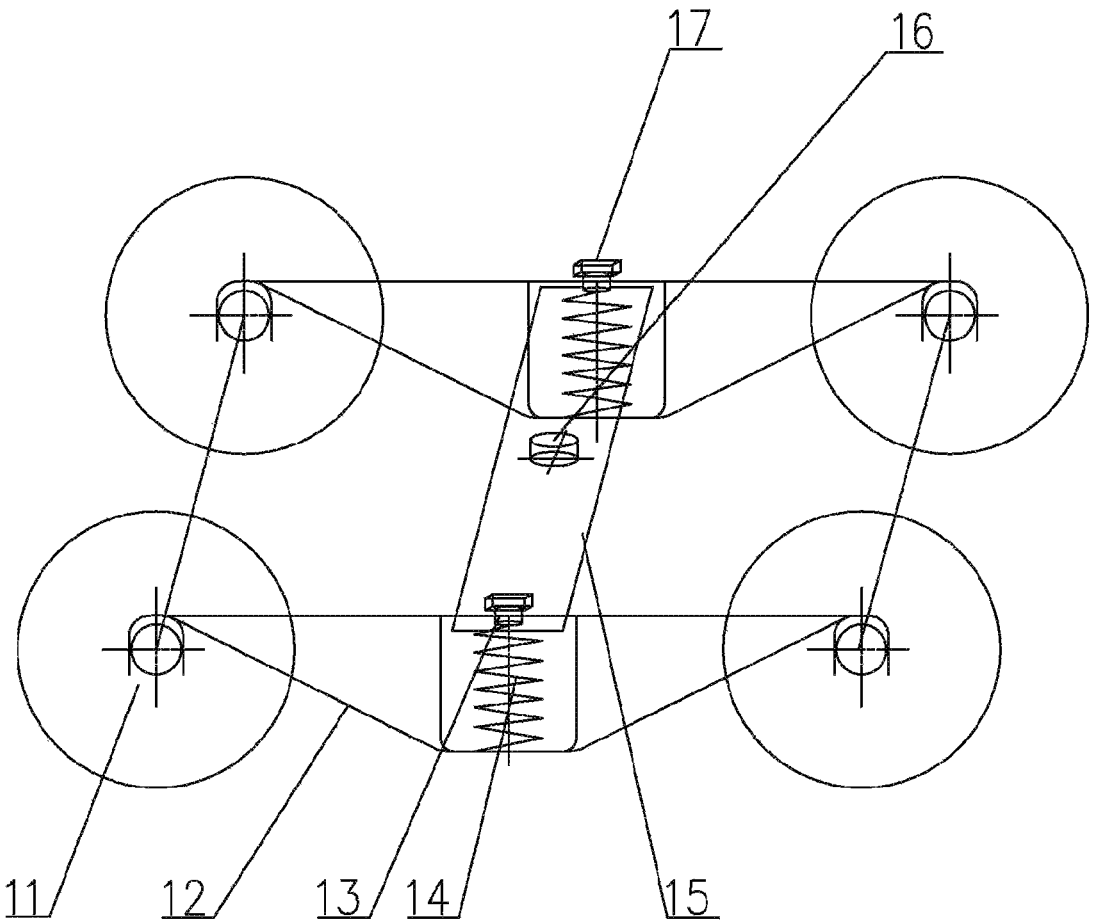
FIG. 1 is a structure diagram of a wheel truck in accordance with one embodiment of the invention.
Figure 2:
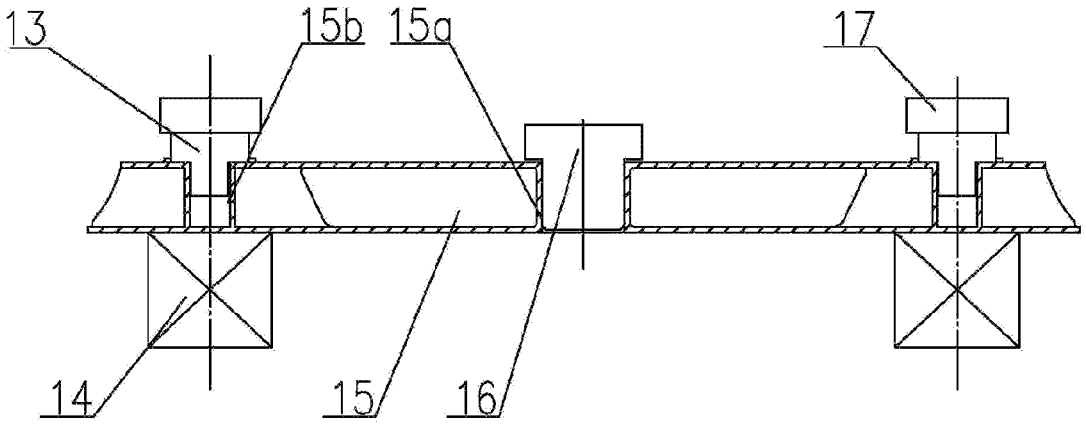
FIG. 2 is a matched structure diagram of a bolster assembly, an upper center plate of a car body, and an upper side bearing of FIG. 1.

As shown in FIGS. 1-2, a wheel truck comprises: a front wheel pair assembly 11 and a rear wheel pair assembly 11, two side frame assemblies 12, a bolster assembly 15, and two spring suspension devices 14. The side frame assembly 12 comprises two journal-box guides on two ends which are disposed on roller bearing adapters of the front wheel pair assembly 11 and the rear wheel pair assembly 11, respectively. Two ends of the bolster assembly 15 are disposed on two spring suspension devices 14 which are disposed in a square box of the side frame assembly 12. The bolster assembly further comprises a pilot hole 15*a* in a center, the pilot hole 15*a* comprises an elastic rubber sleeve and/or an antiwear sleeve for eliminating the impact from the wheel truck on the car body in turning around, reducing the abrasion of the elements, and prolonging the service life. The car body comprises an upper center plate 16 that is cylindrical and is inserted into the pilot hole 15*a*, so that the wheel truck can rotate around the upper center plate 16. Vertical and horizontal forces from the car body are transmitted to the bolster assembly 15 via the upper center plate 16. The bolster assembly 15 further comprises two mounting holes 15*b* disposed on two ends above corresponding spring suspension devices 14. Each mounting hole 15*b* receives a lower side bearing 13 which is matched with the corresponding upper side bearing 17 on each side of the car body. The vertical load from the car body is transmitted to the spring suspension device 14 via the bolster assembly 15; and a bending moment of the vertical load is not produced on the bolster assembly 15.

Figure 3:
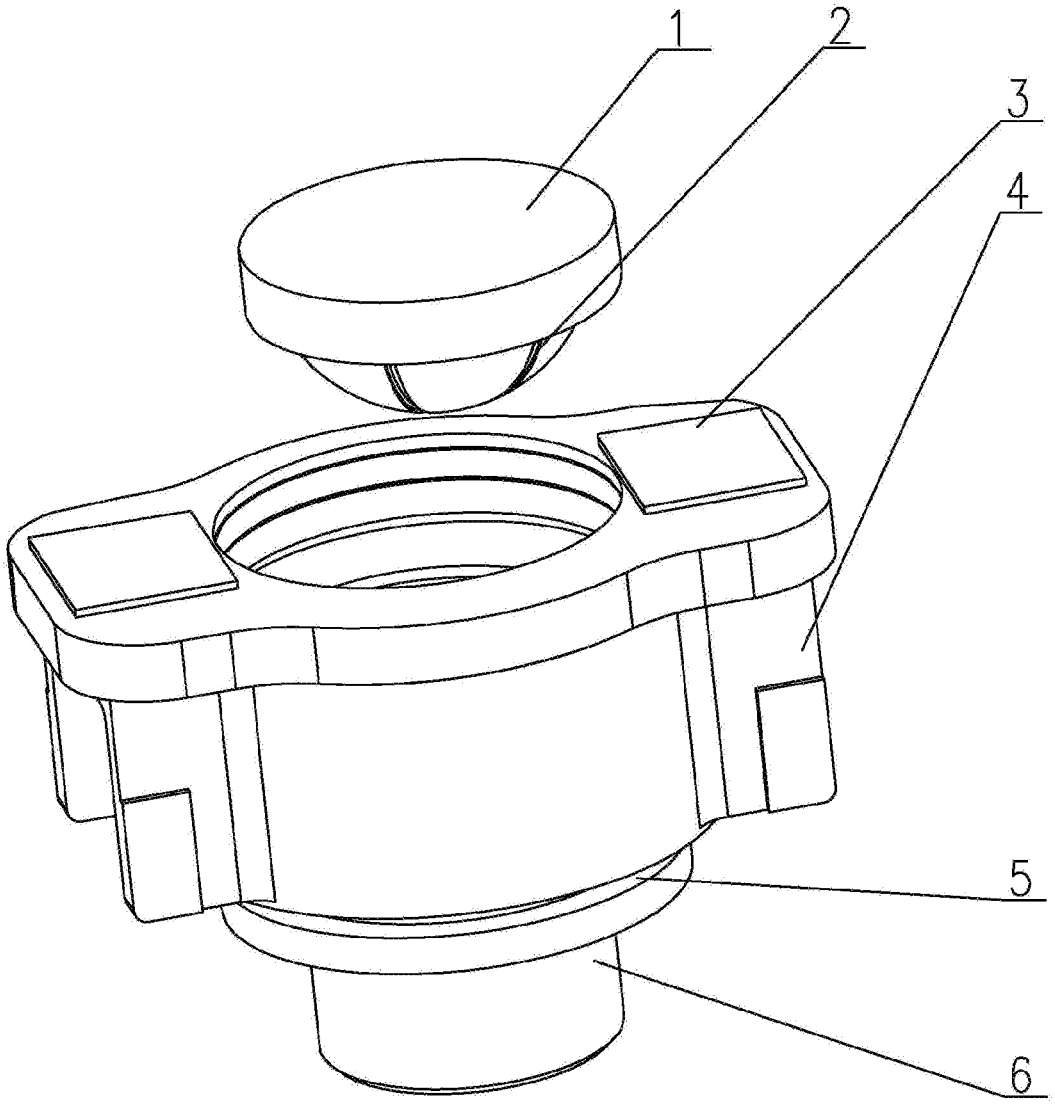
FIG. 3 is a stereogram of a lower side bearing of FIG. 1.
Figure 4:
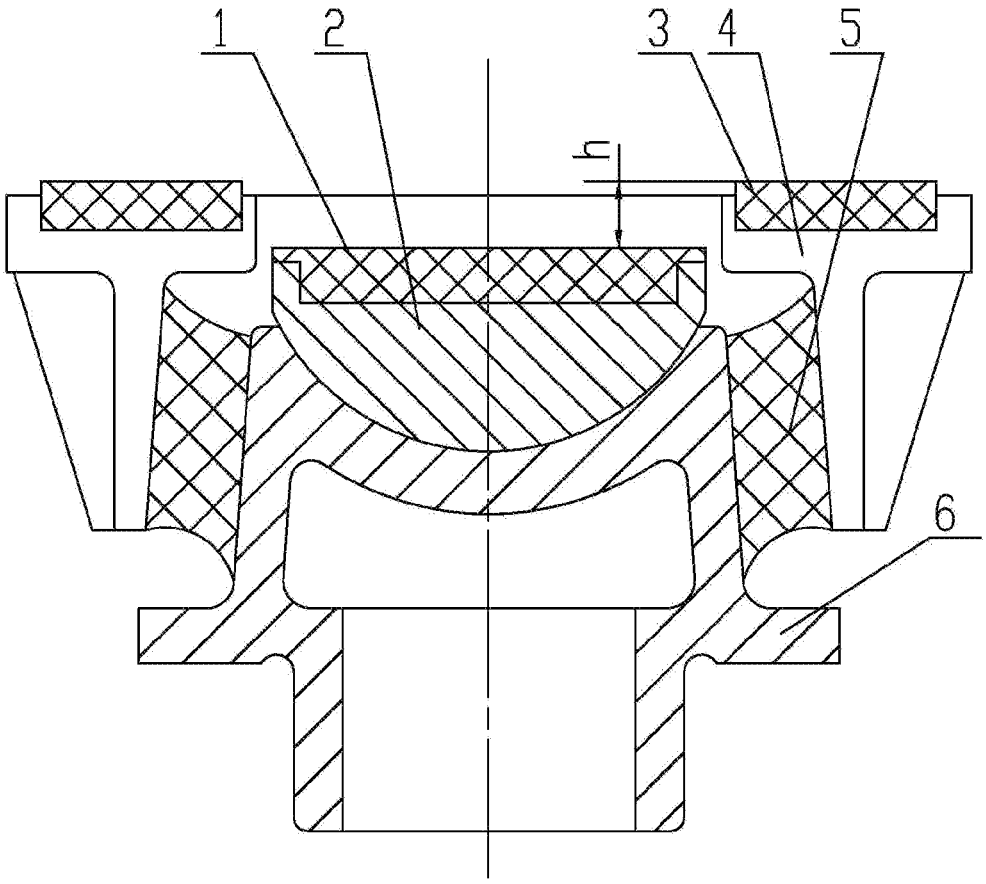
FIG. 4 is a cross-sectional view of a lower side bearing comprising an elastic component made of a conical rubber layer FIG. 3.
Figure 5:
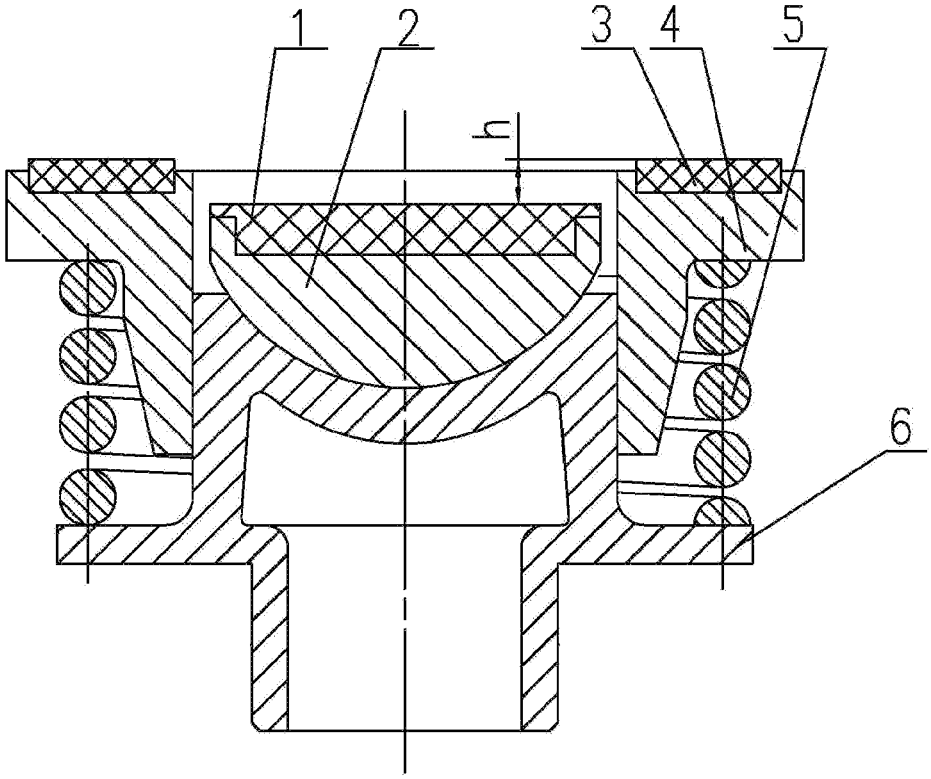
FIG. 5 is a cross-sectional view of a lower side bearing comprising an elastic component made of a spiral reset spring of FIG. 3.

As shown in FIGS. 3-5, the lower side bearing 13 comprises two friction boards for supporting load in empty and heavy states. Specifically, the lower side bearing 13 comprises an inner pedestal 6 in a center and a bearing sleeve 4 that sleeves the inner pedestal 6 and can move upwards and downwards relative to the inner pedestal 6. The inner pedestal 6 comprises a pressure block 2 on the upper part, and the pressure block 2 comprises a second friction board 1 on the top. The bearing sleeve 4 comprises a first friction board 3 on the top. An elastic component 5 is disposed between the inner pedestal 6 and the bearing sleeve 4 for controlling relative positions of the inner pedestal 6 and the bearing sleeve 4. A mechanical property of the elastic component 5 meets the following requirements: in the empty loaded state, a level position of the first friction board 3 is higher than that of the second friction board 1, a height difference h is labeled in FIGS. 4-5; in the heavy loaded state, the level position of the first friction board 3 is equal to that of the second friction board 1. At the same time, a friction coefficient of the first friction board 3 $\mu_k$ and a friction coefficient of the second friction board 1 $\mu_z$ meet the relation that $\mu_k > \mu_z$. In general, the second friction board 1 can be made of polymer materials which have good abrasion resistant capacity and meet the requirement for heavy load. The first friction board 3 can be made of modified nylon materials which not only have a large friction coefficient, but also have good capacity of anti-abrasion and anti-corrosion, and thus, it can alleviate the abrasion on the upper side bearing 17, is convenient to maintain and displace, and largely lower the production cost.

The height difference h controlled by the elastic component 5, the friction coefficient of the first friction board 3 $\mu_k$ and the friction coefficient of the second friction board 1 $\mu_z$ can be designed or adjusted according to the empty loaded state and the heavy loaded state, respectively. In actual manufacturing, the lower side bearing 13 employs the following two structures: One is that an outer wall of the inner pedestal 6 and an inner wall of the bearing sleeve 4 are in the form of conical structures. The elastic component 5 is a conical rubber layer disposed between the outer wall of the inner pedestal 6 and the inner wall of the bearing sleeve 4; and the elastic component 5, the outer wall of the inner pedestal 6, and the inner wall of the bearing sleeve 4 are integrated as a whole by sulfurization (as shown in FIG. 4). Because the shear elasticity of the conical rubber layer is larger than its pressure elasticity, the elastomer formed by the inner pedestal 6, the bearing sleeve 4, and the elastic component 5 has a smaller vertical rigidity and a larger radial rigidity, so that the elastomer can specifically locate the second friction board 1 and the first friction board 3. The other is that the outer wall of the inner pedestal 6 and the inner wall of the bearing sleeve 4 are in the form of sliding fitted cylindrical structures. The elastic component 5 is a spiral reset spring disposed between a lug boss of the outer wall of the inner pedestal 6 and a flange of the inner wall of the bearing sleeve 4 (as shown in FIG. 5). The spiral reset spring has a simple structure; it is not only convenient for manufacturing, installation, and displacement, but also apt to specifically locate the second friction board 1 and the first friction board 3.

Working principle of the lower side bearing 13 is as follows: when the car body is in an empty loaded state, the first friction board 3 is higher than the second friction board 1, that is, a height difference h is formed. In such a state, the upper side bearing 17 presses on the first friction board 3 only. Because the deflection which is produced by the elastomer of the lower side bearing 13 due to the weight of the car body is smaller than the height difference h, the lower side bearing 13 is in an elastic state, and acts as a third elastic suspension system when the freight car is empty loaded. Further, because the first friction board 3 has a larger friction coefficient $\mu_k$, it assures a high critical speed of the wheel truck in the empty loaded state. When the car body is in a heavy loaded state, the first friction board 3 is pressed down and in the same level with the second friction board 1, that is, the height difference between the first friction board 3 and the second friction board 1 is equal to zero. In such a state, the upper side bearing 17 presses on both the first friction board 3 and the second friction board 1. Because the deflection which is produced by the elastomer of the lower side bearing 13 due to the weight of the car body and the load is equal to or even larger than the height difference h, the lower side bearing 13 is in a rigid supporting state and most of the load of the car body is supported by the second friction board 1 when the freight car is heavy loaded. Further, because the second friction board 1 has a smaller friction coefficient $\mu_z$, the wheel truck has a good performance in crossing curved racks in the heavy loaded state.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A wheel truck, comprising:

a) a front wheel pair assembly (11) and a rear wheel pair assembly (11);

b) two side frame assemblies (12), each side frame assembly (12) comprising a square box in a center and journal-box guides on two ends, and the journal-box guides being disposed on roller bearing adapters;

c) two spring suspension devices (14), the two spring suspension devices being disposed in the square boxes of the two side frame assemblies (12), respectively; and d) a bolster assembly (15) comprising two ends which are disposed on the two spring suspension devices (14), respectively;

wherein the bolster assembly (15) further comprises a pilot hole (15*a*) in a center and two mounting holes (15*b*) on the two ends, the pilot hole (15*a*) is rotationally matched with a cylindrical upper center plate (16) of a car body for transmitting vertical and horizontal forces from the car body, and the two mounting holes (15*b*) are disposed above the two spring suspension devices (14), respectively;

each mounting hole (15*b*) receives a lower side bearing (13), and the lower side bearing (13) is matched with a corresponding upper side bearing (17) disposed on each side of the car body for transmitting the vertical load from the car body;

the lower side bearing (13) comprises a first friction board (3), a second friction board (1), an inner pedestal (6), a bearing sleeve (4) sleeving the inner pedestal (6), a pressure block (2), and an elastic component (5);

the pressure block (2) is disposed on an upper part of the inner pedestal (6), and the second friction board (1) is disposed on a top of the pressure block (2);

the first friction board (3) is disposed on a top of the bearing sleeve (4);

a friction coefficient of the first friction board (3) $\mu_k$ and a friction coefficient of the second friction board (1) $\mu_z$ meet the relation: $\mu_k > \mu_z$;

the elastic component (5) is disposed between the inner pedestal (6) and the bearing sleeve (4) for controlling a relative position of the inner pedestal (6) and the bearing sleeve (4); and a mechanical property of the elastic component (5) meets following requirements: a) in an empty loaded state, a level position of the first friction board (3) is higher than that of the second friction board (1) so that the first friction board bears the load of the car body; and b) in a heavy loaded state, the level position of the first friction board (3) is equal to that of the second friction board (1) so that the first friction board and the second friction board bear the load of the car body.

2. The wheel truck of claim 1, wherein an outer wall of the inner pedestal (6) and an inner wall of the bearing sleeve (4) are in the form of conical structures;

the elastic component (5) is a conical rubber layer disposed between the outer wall of the inner pedestal (6) and the inner wall of the bearing sleeve (4); and the elastic component (5), the outer wall of the inner pedestal (6), and the inner wall of the bearing sleeve (4) are integrated as a whole by sulfurization.

3. The wheel truck of claim 1, wherein an outer wall of the inner pedestal (6) and an inner wall of the bearing sleeve (4) are in the form of sliding fitted cylindrical structures; and the elastic component (5) is a spiral reset spring disposed between a lug boss of the outer wall of the inner pedestal (6) and a flange of the inner wall of the bearing sleeve (4).

4. A wheel truck, comprising:

a) a front wheel pair assembly (11) and a rear wheel pair assembly (11);

b) two side frame assemblies (12), each side frame assembly (12) comprising a square box in a center and journal-box guides on two ends, and the journal-box guides being disposed on roller bearing adapters;

c) two spring suspension devices (14), the two spring suspension devices being disposed in the square boxes of the two side frame assemblies (12), respectively; and d) a bolster assembly (15) comprising two ends which are disposed on the two spring suspension devices (14), respectively;

wherein the bolster assembly (15) further comprises a pilot hole (15*a*) in a center and two mounting holes (15*b*) on the two ends, the pilot hole (15*a*) is rotationally matched with a cylindrical upper center plate (16) of a car body for transmitting vertical and horizontal forces from the car body, and the two mounting holes (15*b*) are disposed above the two spring suspension devices (14), respectively;

each mounting hole (15*b*) receives a lower side bearing (13), and the lower side bearing (13) is matched with a corresponding upper side bearing (17) disposed on each side of the car body for transmitting the vertical load from the car body;

the pilot hole (15*a*) comprises an elastic rubber sleeve and/or an antiwear sleeve inside;

the lower side bearing (13) comprises a first friction board (3), a second friction board (1), an inner pedestal (6), a bearing sleeve (4) sleeving the inner pedestal (6), a pressure block (2), and an elastic component (5);

the pressure block (2) is disposed on an upper part of the inner pedestal (6), and the second friction board (1) is disposed on a top of the pressure block (2);

the first friction board (3) is disposed on a top of the bearing sleeve (4);

a friction coefficient of the first friction board (3) $\mu_k$ and a friction coefficient of the second friction board (1) $\mu_z$ meet the relation: $\mu_k > \mu_z$;

the elastic component (5) is disposed between the inner pedestal (6) and the bearing sleeve (4) for controlling a relative position of the inner pedestal (6) and the bearing sleeve (4); and a mechanical property of the elastic component (5) meets following requirements: a) in an empty loaded state, a level position of the first friction board (3) is higher than that of the second friction board (1) so that the first friction board bears the load of the car body; and b) in a heavy loaded state, the level position of the first friction board (3) is equal to that of the second friction board (1) so that the first friction board and the second friction board bear the load of the car body.

5. The wheel truck of claim 4, wherein an outer wall of the inner pedestal (6) and an inner wall of the bearing sleeve (4) are in the form of conical structures;

the elastic component (5) is a conical rubber layer disposed between the outer wall of the inner pedestal (6) and the inner wall of the bearing sleeve (4); and the elastic component (5), the outer wall of the inner pedestal (6), and the inner wall of the bearing sleeve (4) are integrated as a whole by sulfurization.

6. The wheel truck of claim 4, wherein an outer wall of the inner pedestal (6) and an inner wall of the bearing sleeve (4) are in the form of sliding fitted cylindrical structures; and the elastic component (5) is a spiral reset spring disposed between a lug boss of the outer wall of the inner pedestal (6) and a flange of the inner wall of the bearing sleeve (4).

* * * * *